US006016736A

United States Patent [19]

Ghisoni

[11] Patent Number: 6,016,736

[45] Date of Patent: Jan. 25, 2000

[54] FIREARM, PARTICULARLY A REVOLVER PISTOL

[76] Inventor: Emilio Ghisoni, Via Villa Serafina 4, I-27100 Pavia, Italy

[21] Appl. No.: 09/016,437

[22] Filed: Jan. 29, 1998

[30] Foreign Application Priority Data

Jan. 30, 1997 [IT] Italy ..... MI97A0175

[51] Int. Cl.[7] ..... F41G 1/033; F41A 19/53

[52] U.S. Cl. ..... 89/157; 42/62; 42/65; 42/66; 42/100

[58] Field of Search ..... 42/62, 65, 66, 42/67, 100; 89/155, 156, 157, 172, 162

[56] References Cited

U.S. PATENT DOCUMENTS

| | | | |
|---|---|---|---|
| 584,631 | 6/1897 | Fosbery | 89/157 |
| 1,972,763 | 9/1934 | Dutton | 42/65 |
| 2,382,676 | 8/1945 | Swartz | 42/62 |
| 3,055,270 | 9/1962 | Miller | 89/157 |
| 4,151,782 | 5/1979 | Allen | 89/155 |
| 4,856,410 | 8/1989 | Anderson | 89/155 |

*Primary Examiner*—Stephen M. Johnson
*Attorney, Agent, or Firm*—Herbert Dubno

[57] ABSTRACT

Revolver firearm comprising a body divided in an upper part, or slider, comprising a barrel and a drum, slidingly associated with a lower part, or case, comprising a handle, a trigger and a hammer; a first kinematic chain arranged in said case for arming the hammer; a second kinematic chain, arranged in said slider, and adapted to cause the rotation of the drum and to successively align the firing chambers of the drum with the barrel, the first and second kinematic chains being selectively activated by manually operating the hammer directly or the trigger or using the forces generated by the recoil; a third kinematic chain for connecting the first and second chains; the third kinematic chain has a desmodromic member having an active transfer action synchronously transferring motion from the first chain to the second chain during the firing action and a resistance passive action during the automatic re-cocking of the firearm caused by the recoil forces.

10 Claims, 10 Drawing Sheets

FIREARM, PARTICULARLY A REVOLVER PISTOL

FIELD OF THE INVENTION

The present invention relates to a firearm, particularly a revolver pistol.

BACKGROUND OF THE INVENTION

The need of an automatic revolver has always been felt. Fosbery was the first one to modify the revolver of Webley to make it automatic. In the Webley-Fosbery revolver, the body of the weapon is divided in two parts associated by means of sliders and free to move relatively to a certain extent. The upper part of the weapon, which comprises the barrel, cylinder and hammer, in reaction to the shot, moves back with respect of the lower part, which is constituted by the handle and by the trigger support. During this backward motion, the hammer is forced to rotate because its rear part abuts against an inclined plane of the lower part of the body. A lever connected to the hammer acts against the teeth of the drum causing it to rotate. A first drawback of such automatic revolver is that the rotation of the drum occurs at recoil and is consequently violent and can cause damage to parts of the revolver.

An attempt to reduce such inconvenience by inserting a shock absorbing spring between the moving parts has not been successful.

The above inconvenience was overcome by increasing the diameter of the cylinder and by providing the outer portion of the cylinder with zigzag slots adapted to receive a peg associated with the lower part of the body. The action of the peg in the inclined walls of the slots during the backward motion and the return of the upper part of the body causes the rotation of the cylinder. The advantage of a greater strength of this device is however countered by two drawbacks.

A first drawback is that the drum has a considerable size and the second drawback is that it is impossible to rotate the drum without moving the two parts of the firearm. This second drawback is particularly severe. This above described revolver has the following disadvantages.

Stressing and breaking of the lever members undergoing a violent action during the recoil.

In the case of a defective cartridge, it is impossible to take advantage of the typical feature of revolvers that simply allow a pull of the trigger to fire another round.

The firearm must be held firmly in the automatic operation to prevent the transformation of the recoil action into a pitch of the firearm rather than a sliding action of the slider because there is a considerable distance between the axis of the barrel and the rest of the firearm on the hand.

The rotation of the cylinder and the re-cocking of the hammer in the conventional revolvers occur in substantially two ways.

By means of the so-called SA (single action) the hammer is armed by pulling it backwards with the thumb. The index pulls the trigger with a very short stroke (less than 1 mm) to release the hammer.

Shooting DA (double action) with the index finger pulling the trigger with a stroke of about 12 mm arming the hammer, rotating the drum and subsequently firing, with a force on the trigger of about 5 Kg.

In the conventional revolvers both actions are produced by muscular force.

OBJECTS OF THE INVENTION

An object of the present invention is to provide a revolver that overcomes the drawbacks of the prior art firearms.

Another of the invention is to provide a revolver having a third type action by comparison with conventional revolvers.

A further object of the invention is to provide a revolver that in case of defective cartridge, simply allows pulling of the trigger again (DA) or to re-cocking of the hammer (SA) to keep firing.

SUMMARY OF THE INVENTION

The above aims, and other aims. These and other objects that will become apparent to those skilled in the art, are achieved by a revolver firearm comprising a body divided into an upper part, or slider, comprising a barrel and a drum, and a lower part, or case, comprising a handle, a trigger and a hammer on which the upper part is slidable. At least a first kinematic means is arranged in the case for arming the hammer. At least a second kinematic means is arranged in said sliding slider and is adapted to cause the rotation of the drum and to successively align the firing chambers of said drum with the barrel, the first and second kinematic means are selectively activated by manually operating directly the hammer or the trigger or using the forces generated by the recoil. Third kinematic means connects the first means to the second means. The kinematic means comprising a desmodromic member having an active transfer action synchronously transferring motion from the first means to the second means during the firing action and a resistance passive action during the automatic re-cocking of the firearm caused by the recoil forces.

BRIEF DESCRIPTION OF THE DRAWING

Further characteristics and advantages of the invention will be more apparent by the following description of an embodiment of the invention, illustrated, by way of example in the accompanying drawings in which.

DESCRIPTION OF THE PREFERRED EMBODIMENTS OF THE INVENTION

Figure 3:
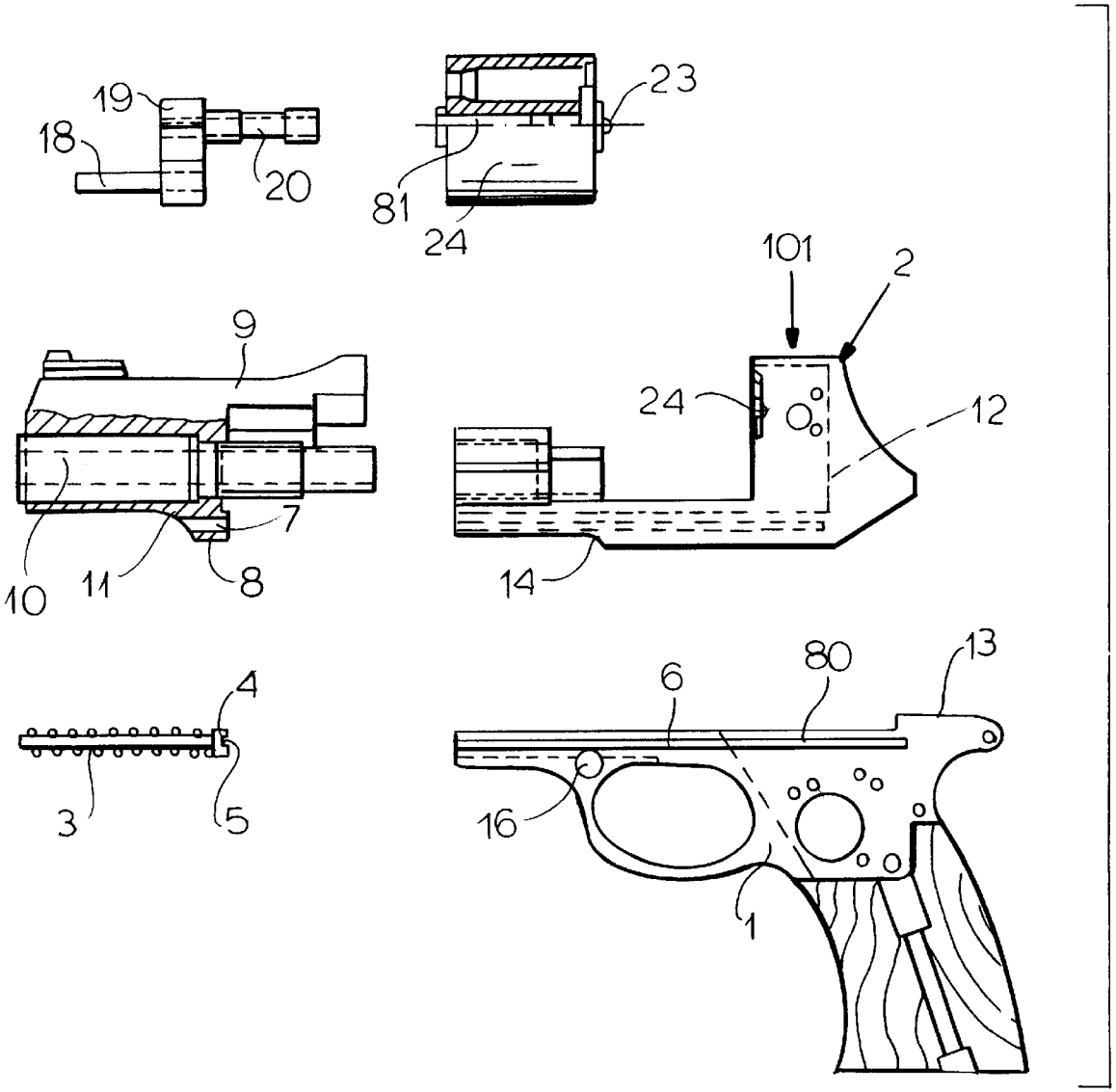
FIG. 3 is a partial exploded lateral view of the revolver according to the invention.

The revolver according to the invention, generally designated by the reference numeral 101, comprises a case 1 and a slider 2 mobile on guides 80 (FIG. 3) with respect to the case and biased to its original position by a spring 3 wound on a spring guide 4 resting, with its base 5, on a pin 6 planted in the case.

At the front, the spring guide 4 is freely arranged in a hole 7 of an appendix 8 of the guard 9. The guard 9 is received between the barrel 10 and the slider 2, wherein the barrel is screwed, by means of the step formed by the different diameters of the barrel.

A washer 11 is arranged at the site of contact between the guard and the barrel and has the following function: by varying the thickness of the washer 11, for example using washers of different thickness, the critical distance between barrel and drum can be varied, thus providing for the use of barrels of different length in the revolver.

The run of slider-barrel-guard assembly is stopped backwards by teeth 13 constituted by projections formed on the upper side of the case.

The forward run of the slider-barrel-guard assembly, biased by spring 3, is stopped by its circular sector steps 14 against projecting parts from the case constituted by a pin 15 arranged in the hole 16.

Figure 5:
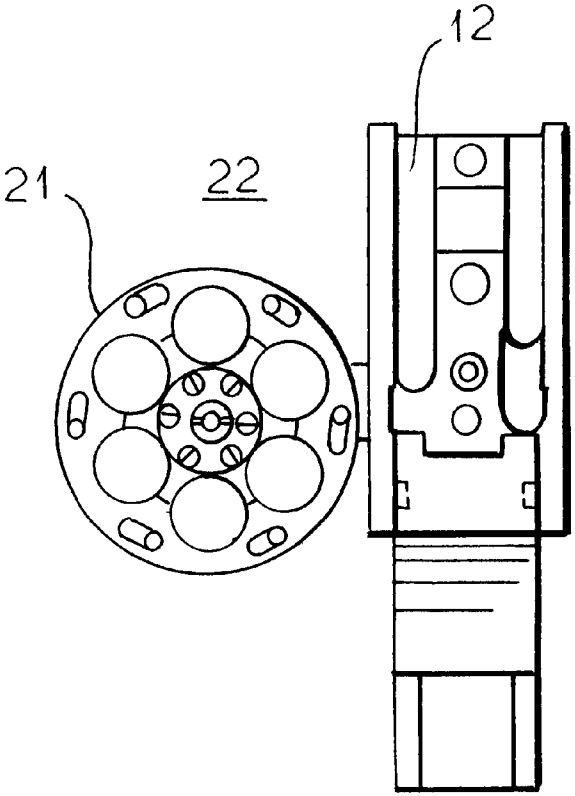
FIG. 5 is a partial rear view of the revolver without the closure plate.

A pin 18 (FIG. 3) is arranged in hole 17 (FIG. 4) and constitutes the axis of a crank 19 having an arm 20 centrally passing through the cylinder 21. Crank 19 allows the cylinder 21 to swing into the external position 22 (FIG. 5) adapted to allow the insertion and expulsion of the cartridges.

It should be noted that the crank of conventional revolvers is C-shaped because its pivot extends from the arm. Such a C shape, in the present case, would entail manufacturing difficulties and would increase the bulk of the firearm when the barrel is aligned with the lower firing chamber of the cylinder.

Figure 4:
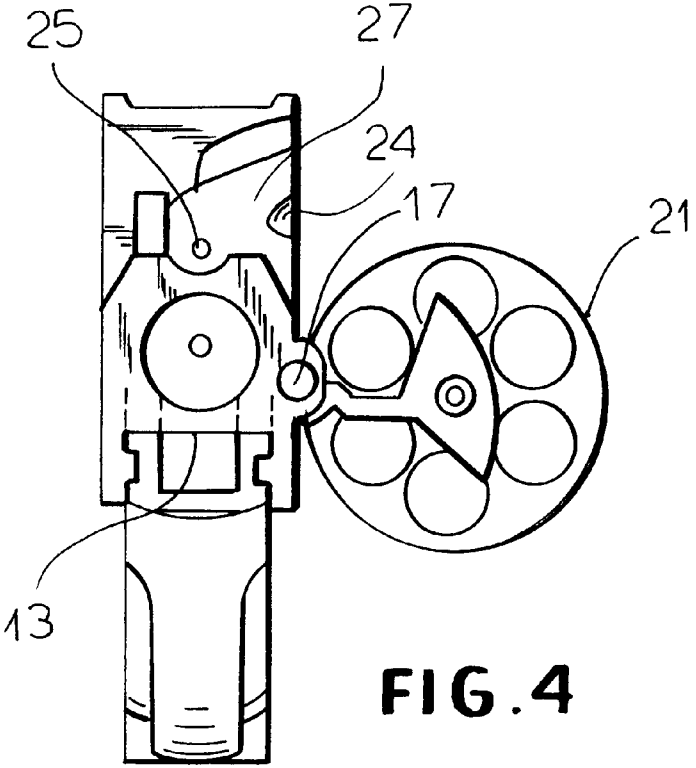
FIG. 4 is a partial front view of the revolver.

The revolver further comprises a structure adapted to retain or to release the cylinder in or from the normal position. This structure comprises a plunger 23 outwardly biased by a spring 81, which is arranged in the extractor, the plunger being pushed, during the inward return swing of the cylinder 21 by the inclined plane 24 until the plunger 23 is again inserted into hole 25 (FIG. 4).

In order to release the cylinder 21, a small rod 26, slidingly arranged in hole 25, pushes the piston 23 in to the plane 27 and, by laterally pushing on the cylinder 21, the piston 23 can slide on the plane 27.

Figure 1:
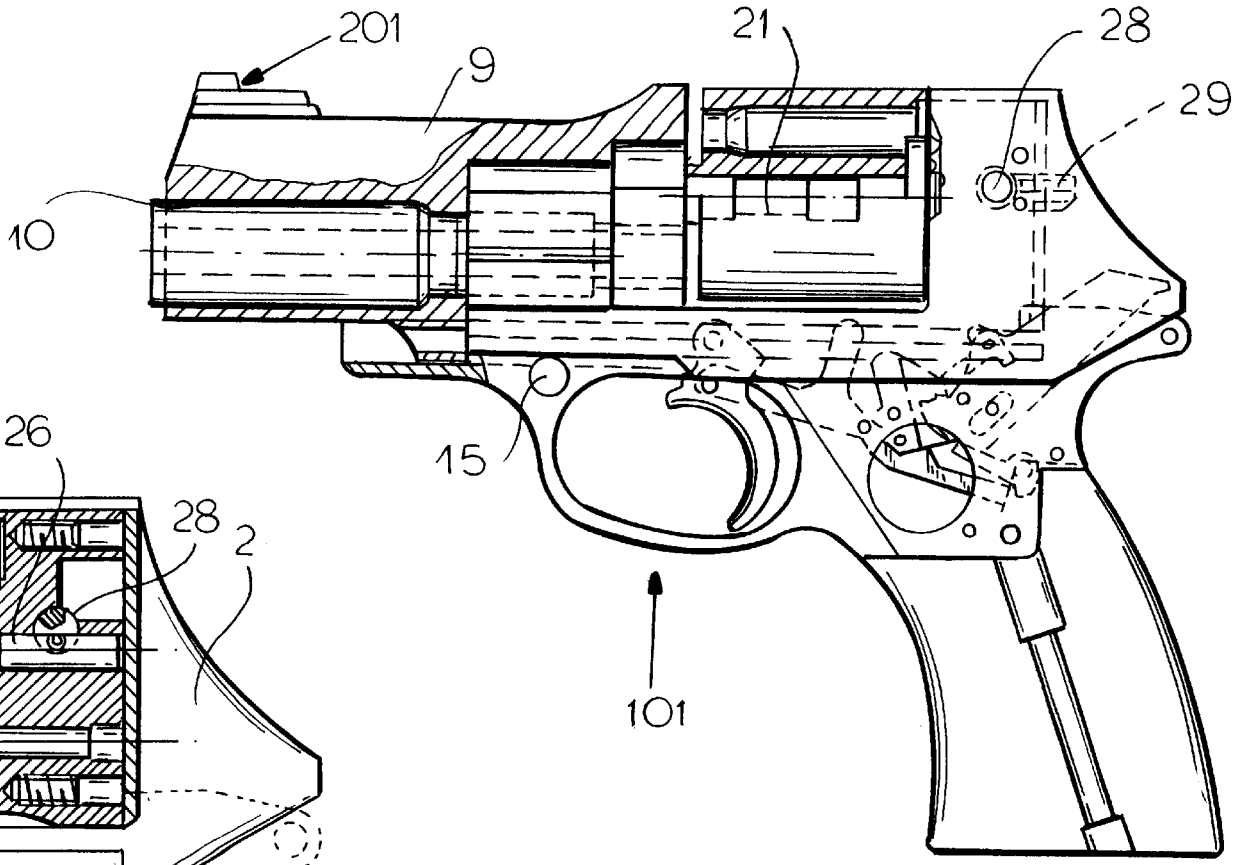
FIG. 1 is a lateral partial sectional view of the revolver according to the invention with the slider in the rearward position.
Figure 2:
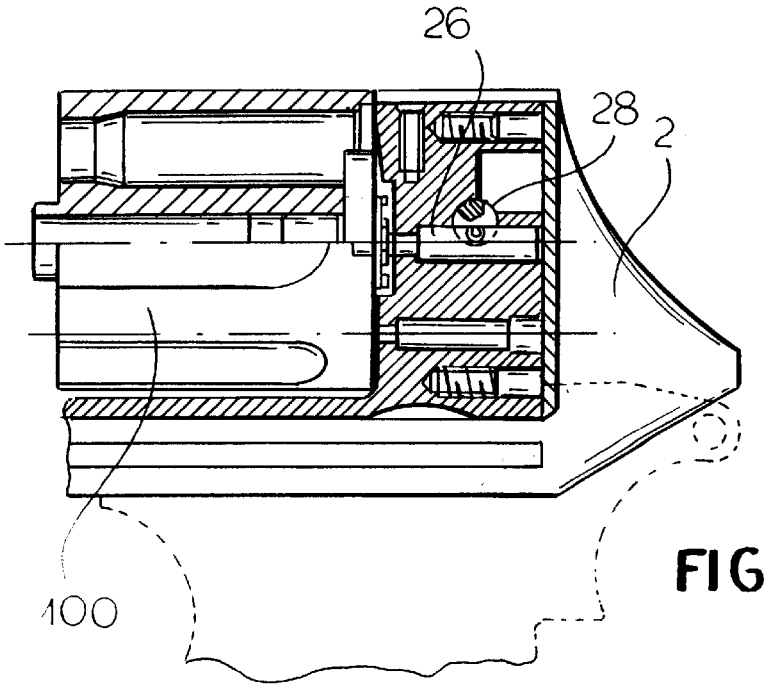
FIG. 2 is a lateral enlarged sectional view of the drum.

According to the invention, rod 26 (FIG. 2) is controlled by the rotation of a peg 28 which is transverse to the rod 26 and which has several functions.

The control of peg 28 is manual by means of wings 29 associated with the peg by means of screws 82 having a cylindrical point and traversing the wings.

Figure 8:
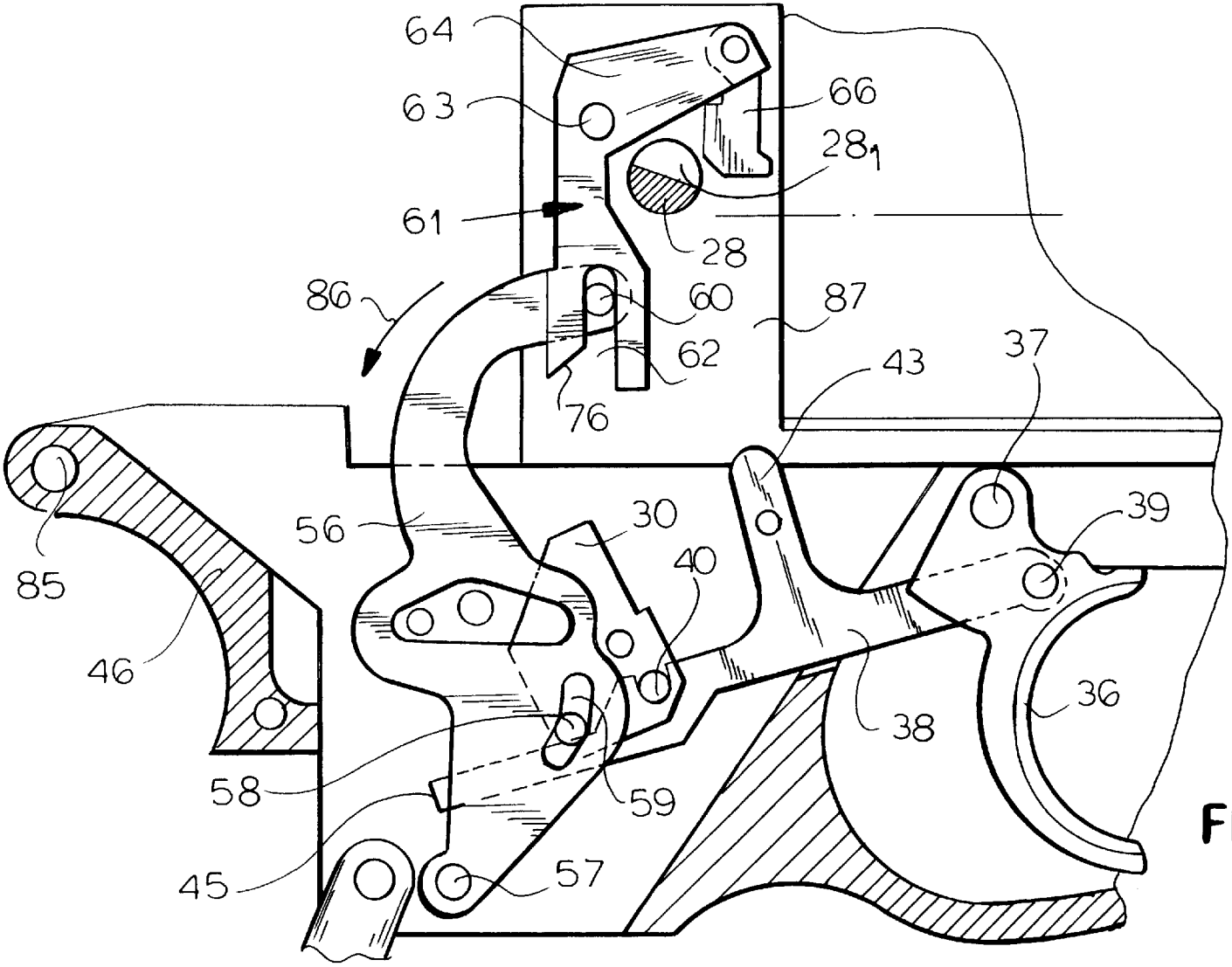
FIGS. 8 and 9 are lateral partial sectional views of the connecting system of the mechanism located in the case with the mechanism located in the slider.
Figure 9:
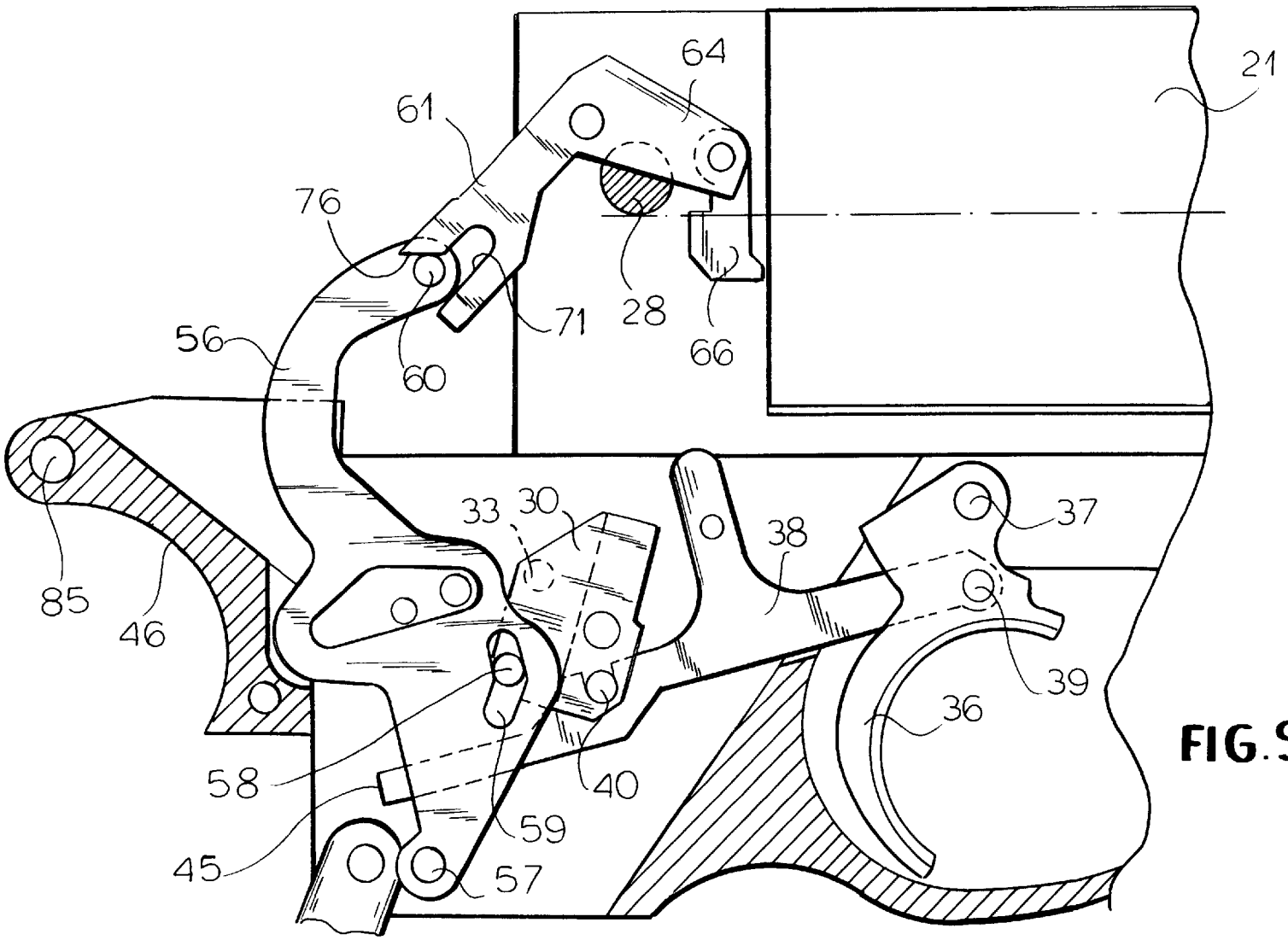

A second function of peg 28 is that of preventing the drum from opening when the hammer is armed, as the appendage 64 of the fork member 61 (described below) interferes with slot 28, of the peg 28 preventing the rotation (FIGS. 8 and 9).

On the contrary, when peg 28 is rotated it prevents the arming of the hammer if the cylinder 21 is not in the correct position. The correct position is given by the plunger 23 inserted in the hole 25 pushing away the small rod 26 which causes peg 28 to rotate.

Figure 11:
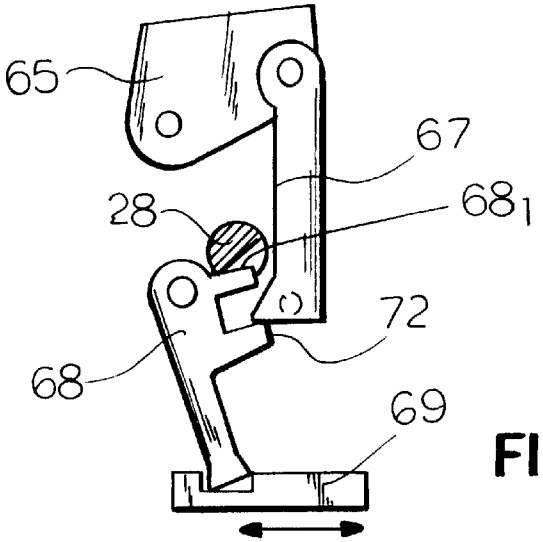
FIG. 11 is a partial view, similar to that of FIG. 8, of the chain of elements adapted to operate the drum.
Figure 12:
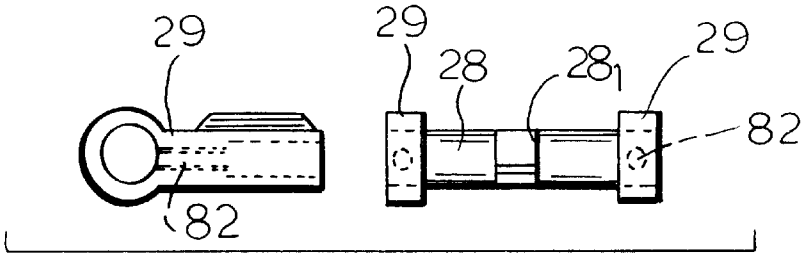
FIG. 12 is a partial exploded view of the cylinder controlling the side motion of the drum.

In order to extract the cylinder 21, besides requiring the small rod 26 to move back, also the rod 69 has to move back since it fixes the position of each firing chamber in front of the barrel (see FIG. 11).

To this purpose, a cut or slot in the peg 28 is provided such that rotation of the peg 28 cams against the plane 68, of the pawl 68 engaging the rod 69 (FIG. 11).

The case contains a firing chain conceptually similar to the firing mechanism of the Walther Parabellum pistol but also having a specific further member adapted to operate the mechanisms contained in the slider for moving the cylinder 21 and for locking the cylinder 21 in the firing position.

Figure 6:
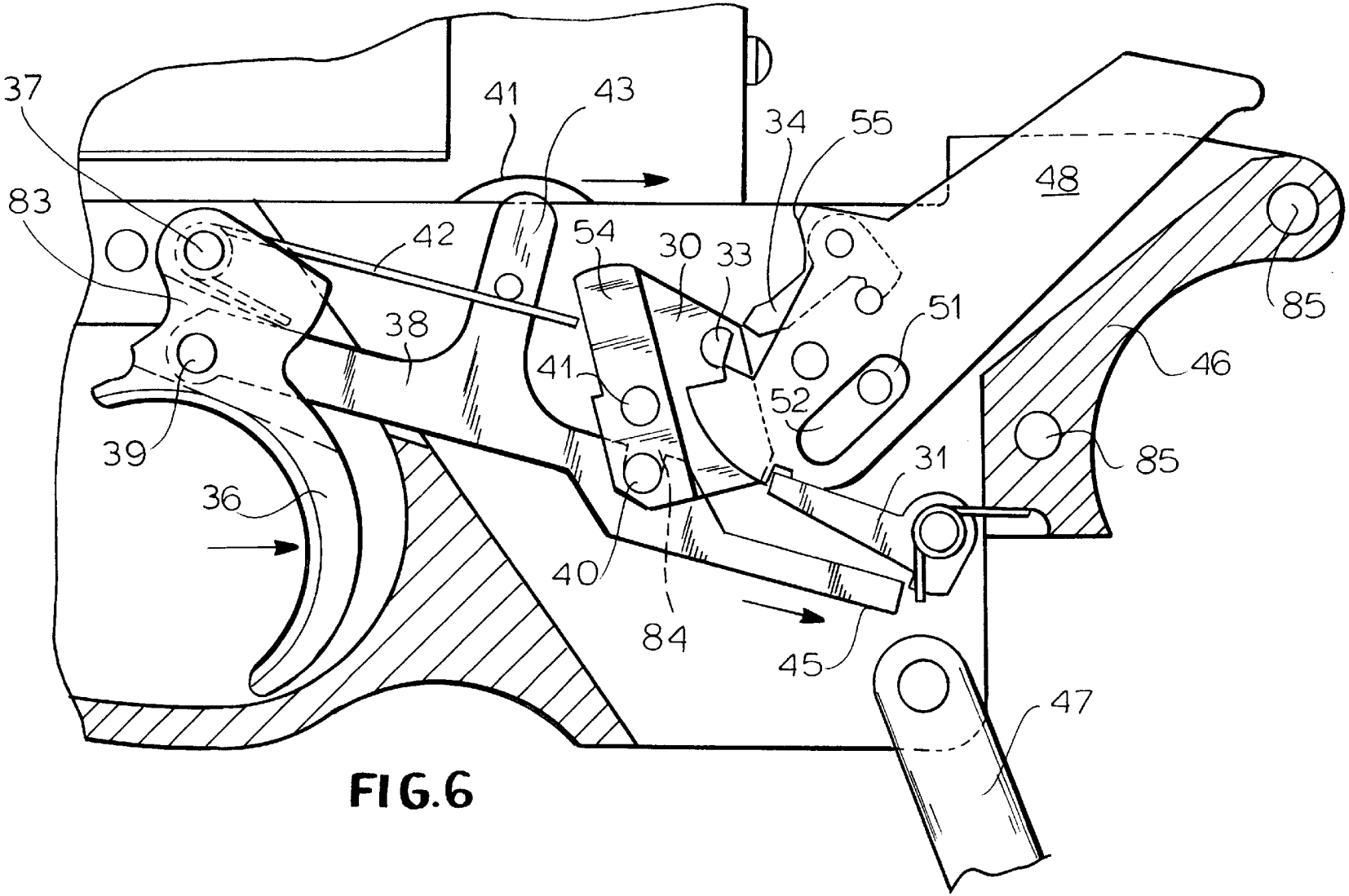
FIG. 6 is a schematic lateral sectional view of the firing mechanism in the position ready to fire.

With particular reference to FIG. 6, a pin 33 forms a motive appendage 33 of a distributor 30 and motor appendix 33 is interposed between a mobile part 34 and a fixed part 35 (FIG. 7) of hammer 48 and has a cylindrical shape with a circular portion 90 which allows the passage of the mobile part 34 at the top of the run in the DA (Double Action). In this manner the difference between the angular runs of the DA and SA (Single Action) is only 4°, against the 12° to 15° angular run of conventional revolvers.

A trigger 36 (FIG. 7) rotates on a pin 37, and has a cut or slot 83, receiving a rod 38 pivoted at 39 on the trigger and at 40 on the distributor 30, by means of the open slot 84 (FIG. 6). The distributor is pivoted in 41.

This "chain" of pieces is biased by return spring 42. The appendage 43 of rod 38, when the slider is in the rest position, is received in a seat 41 of the slider. The terminal portion 45 of the rod 38 can engage the hammer 31 making it rotate pawl 31, causing it to rotate thereby causing the release of the hammer 48.

The backward motion of the slider forces the rod 38 downwardly releasing it from the pawl 31. This operation is called release and only in this manner, assuming the trigger has been pulled and the shot fired, is the pawl 31 again free to reengage the hammer.

An insert 46 (FIG. 9) closes the case structure and is fixed to it by two rivets 85. This solution considerably eases the workings inside of the case.

A piece 47 assists in locking the handle to the case.

Figure 7:
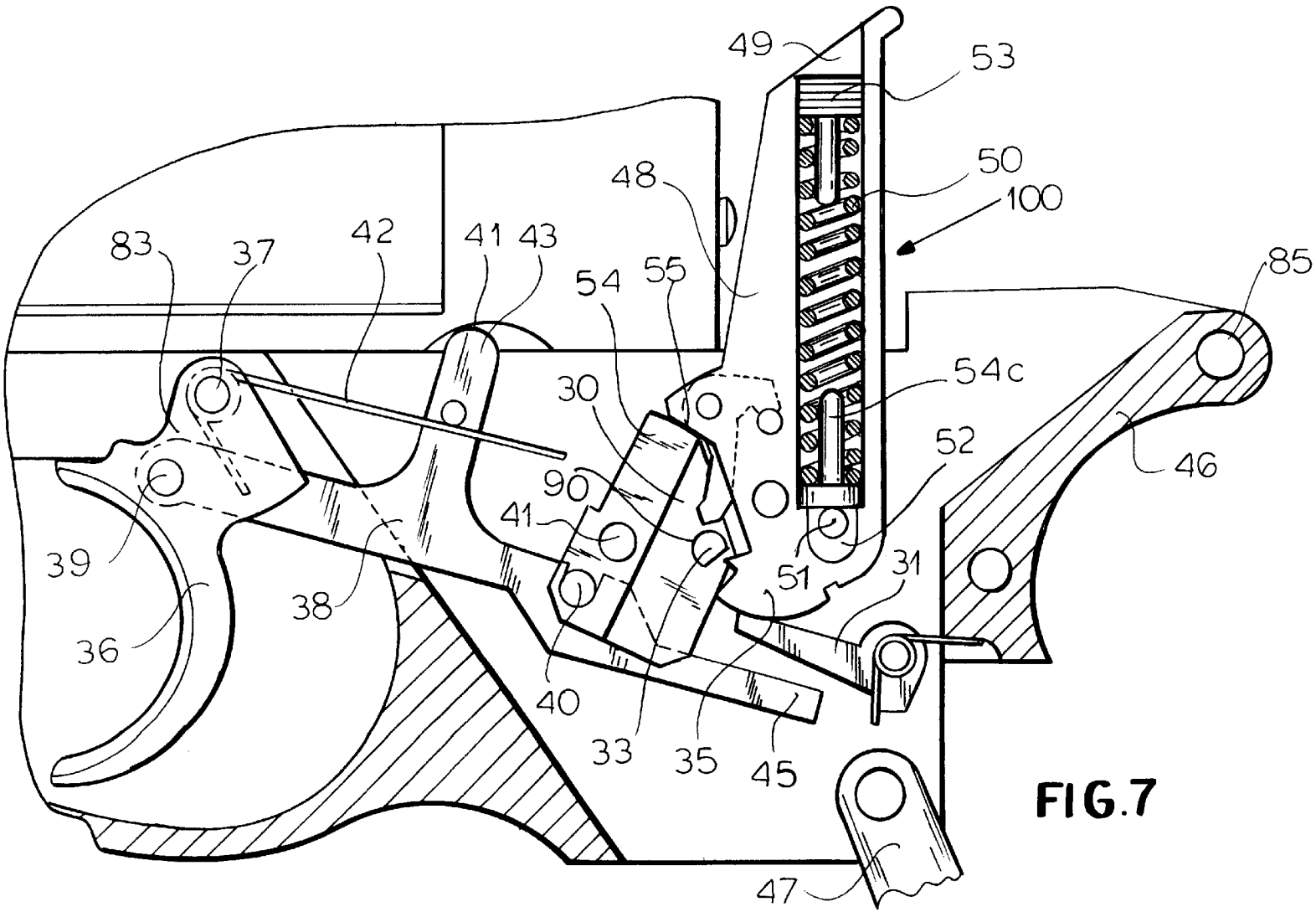
FIG. 7 is a view similar to the preceding one with the firing mechanism in the rest position.

FIG. 6 shows the mechanism in the position ready to fire while FIG. 7 shows the mechanism in the rest position. It should be noted that the hammer 48 is transversed by a bore 49 (FIG. 7) containing a spring 50 which, during the rotation of the hammer (clockwise), is compressed (and slows down the slider) because of the resistance of pin 51 seated in the two walls of the case and passing through the hammer through the slot 52.

Bore 49 has an upper through part and has an initial threaded part which can be closed by a screw 53 acting as regulator of the spring force. This is a very advantageous and useful function.

On the side opposite the screw, a piston 54*c* slides in the bore until it stops. In fact, the hammer may move backwards for 7°, in the illustrated example, from the complete drawn position before such contact is effected.

This fact allows the upper part 54 of the distributor to be inserted below the inclined plane 55 of the hammer thereby raising the hammer, without resistance, of 7°, thereby keeping the hammer away from the firing pin (FIG. 7). This is achieved by releasing the trigger and constitutes the so-called automatic safety which, in the conventional revolvers, is provided with different means.

FIGS. 8–9 better show the connection between the mechanism arranged in the case and the mechanism arranged in the slider. Such connection is provided by means of piece 56 pivoted at 57 and taking its motion from a pin 58 formed in the side of the distributor opposite the side provided with small pin 33 acting on the hammer.

In the first part of the rotation of the distributor 30, and just before its motion causes the maximum arming of the hammer, the sliding action of the pin 58 inside the slot 59 causes the piece 56 to move backwards (arrow 86 of FIG. 8).

During the rest of the rotation of distributor 30, the slot assumes such a configuration that the connecting member 56 and, importantly, no force acting upon the connecting member 56 may move the distributor 30 (FIG. 9).

When the trigger is released, and consequently the rod 38 entrains the distributor by means of the spring 42, the pin 58 moves along the neutral portion of the slot and moves the piece 56 back to its initial position.

The upper portion of the connecting piece 56 enters a cut or slot 87 formed in the slider and its pivot 60 engages the fork piece 61, of the mechanism contained in the slider, with the open slot 62.

The fork piece 61 is pivoted at 63 and has two arms 64 and 65. Arm 64 has a piece 66 adapted to cause the rotation of the cylinder 21 by engaging the teeth of the extractor.

Figure 10:
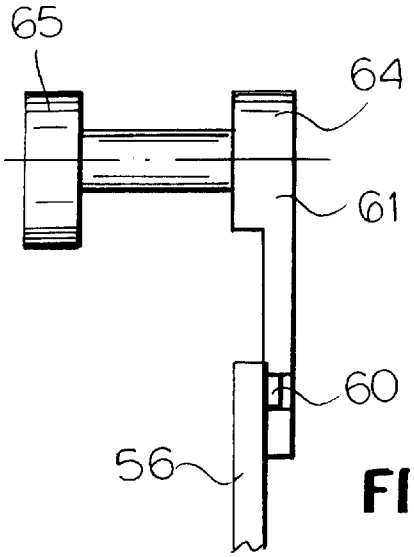
FIG. 10 is a partial front view of the fork member.
Figure 13:
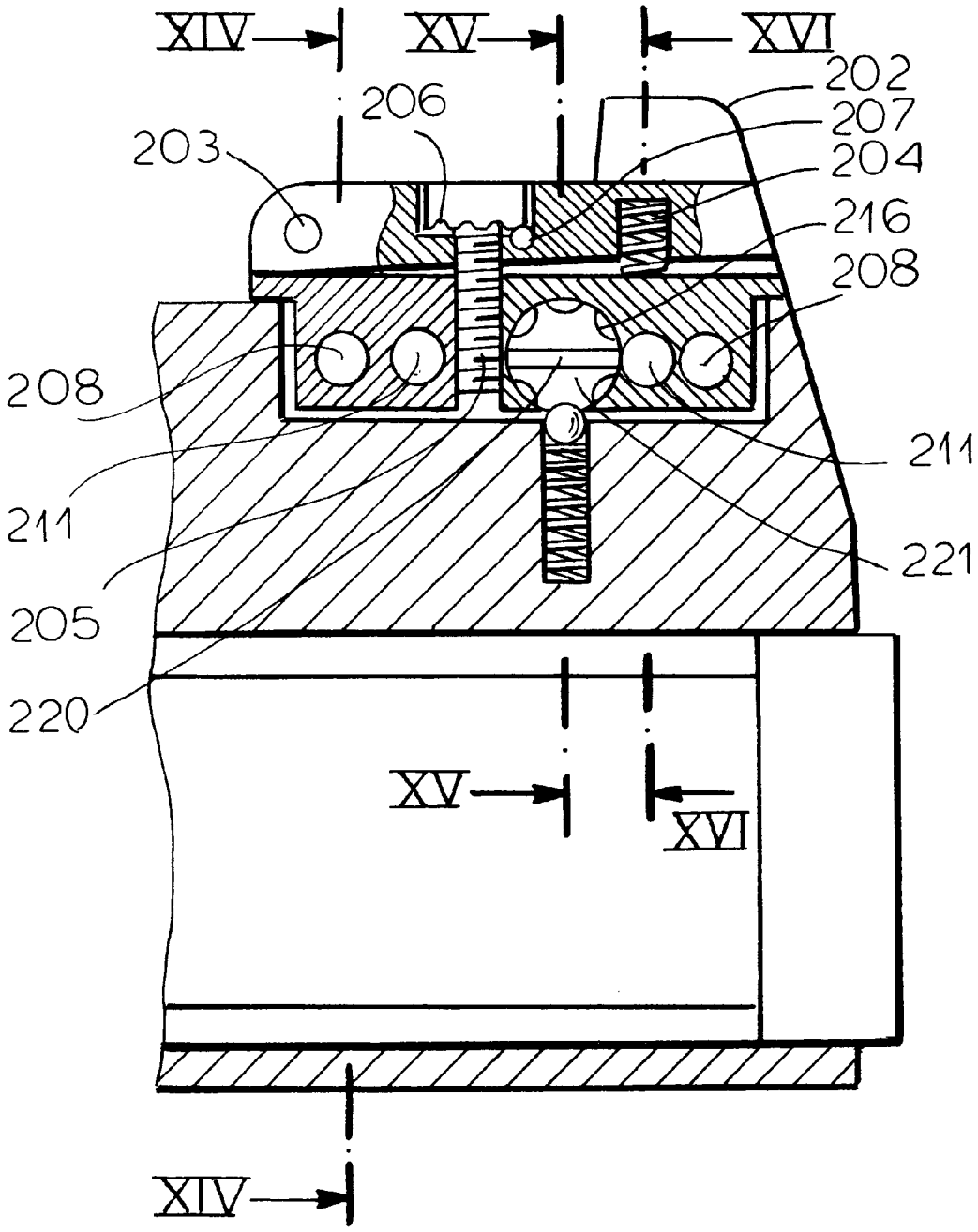
FIG. 13 is a sectional view of the mobile sight according to the invention.
Figure 15:
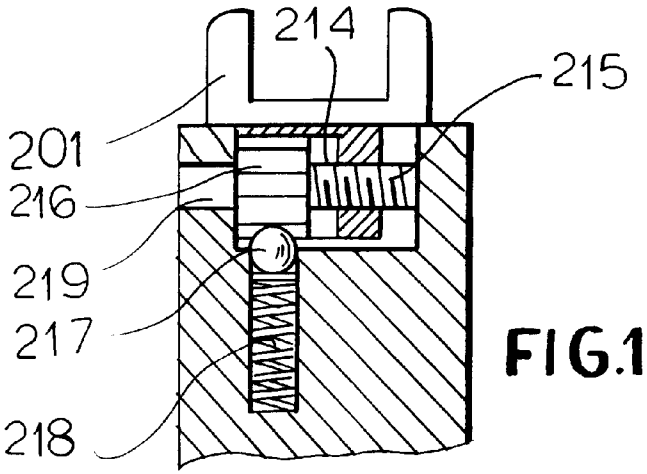
FIGS. 14, 15 and 16 are section views respectively according to section lines XIV—XIV, XV—XV, and XVI—XVI of FIG. 13.
Figure 16:
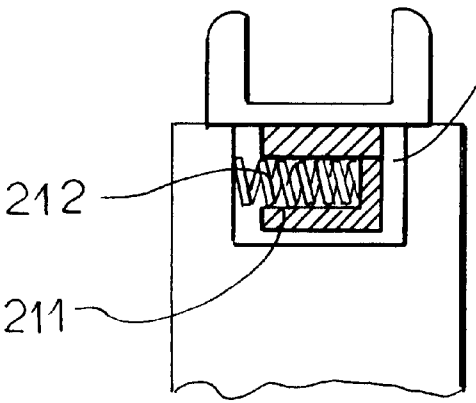
Figure 14:
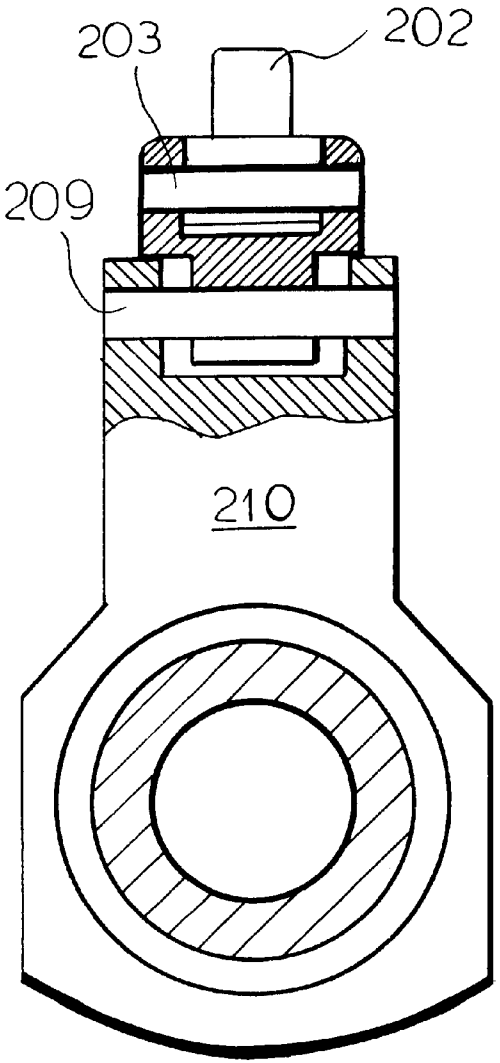

Arm 65 (FIGS. 10 and 11) has a piece 67 (FIG. 11) which constitutes the first member of a chain adapted to lock and unlock the cylinder 21 in the firing position.

The operation of the mechanism will be now described starting from the rest position (released trigger and hammer in the automatic safety position).

Both by pulling the trigger (DA) or aiming the hammer (SA), the distributor 30 is actuated and in turn actuates the connecting piece 56 so that its pin 60 effects a 17 mm motion (or in any case equal to that of the slider) towards the user, thereby actuating the fork piece 61 until it reaches an escapement position on its inclined plane 76 (FIG. 8).

The rotation of fork piece 61, and displacement of piece 66 on its arm 64, causes the cylinder 21, to rotate, since the piece 67, which escapes on the appendage 72 of pawl 68, had already moved back the rod 69 which locked it and, by falling down, locks, it in the new position.

When the hammer is released and the round is fired, the slider moves back pushing the hammer and causing its arming. At the same time the wall 71 (FIG. 9) of the slot of the fork finds the opposition of the pin 60 and makes the fork return in the rest position. In particular, the piece 66 rides off the following tooth of the cylinder 21 and the piece 67 returns behind the appendage 72.

At this point, the slider is biased by the spring 3 to the front and the pin 60 retains the fork piece 61 causing its rotation. The actions described for the SA action are thereby repeated.

The motion of the connecting member 56 prepares the automatic firing action and its resistance makes the automatic operation possible.

It should also be noted that the possibility of exchanging the barrel with different ones facilitates the adjustment of the sight, according to the present invention, whereas a traditional sight requires adjustment every time the barrel is changed.

The adjustable sight FIGS. 13–16 is constituted by a slider 201 and by a sight portion 202 associated with the slider by means of a pin 203.

A spring 204 in the sight portion 202 keeps the sight resting on a screw 205 screwed on the slider 201 and selectively engaging a plurality of dents 206 with a ball 207 associated with the slider.

The rotation of screw 205 allows the upward and downward motion of the sight 202 with respect of slider 201. The slider 201 has two holes 208 traversed by respective pins fixed to the guard 210.

Pins 209 function as guides for the sliding motion of the slider 201 biased by two springs 212 located in blind bores 211.

The springs work between the blind bores 211 and a side of the slot or cut 213 wherein the slider is arranged.

The slider transversely bears two coaxial holes 214 and 215 having different diameters.

The head of a screw 221 is arranged in hole 214 and perimetrally has dents 216 into which a ball 217 is biased by a spring 218 arranged in a hole of the sight support.

Through the hole 219 it is possible to act on the screw 221 which is contained between the two parallel walls of cut 213.

The screw 221 engages the threaded hole 215 and, by rotating, moves the slider against or together with springs 212.

It has been seen in practice that the invention achieves the intended aims and objects.

Among the several advantages of the present invention are that the case has small dimensions and does not exceed the height of the trigger guard. Furthermore, the handle does not contain any mechanism and may therefore be modeled as desired.

In order to provide the revolver according to the invention, substantial innovations had to be made both to the general structure of the firearm and to its internal mechanisms.

The firearm according to the invention may have numerous modifications and variations, all within the inventive concept; furthermore, all the details may be substituted with technically equivalent elements.

The materials employed, as well as the dimensions, may be any according to the specific needs and the state of the art.

I claim:

1. A revolver firearm comprising:

an upper part forming a slider and comprising a barrel and a cylinder;

a lower part forming a case and comprising a handle, a trigger and a hammer and on which said upper part is slidable;

a first kinematic means arranged in said case for arming said hammer;

a second kinematic means, arranged in said slider and adapted to cause rotation of said cylinder and to successively align firing chambers of said cylinder with said barrel, said first and second kinematic means being selectively activated by direct manual operation of said hammer and said trigger or by a force generated by recoil of the slider; and third kinematic means for connecting said first means to said second means, said third kinematic means comprising a connecting member having an active transfer action synchronously transferring motion from said first means to said second means during a firing action and a resistance passive action during an automatic re-cocking of the firearm caused by a recoil force.

2. The firearm according to claim 1 wherein said trigger rotates about a pivot and has a cut, said first means including a rod in said cut pivoted on said trigger and on a distributor by means of an open slot.

3. The firearm according to claim 2 wherein said second means comprises a fork piece comprising two arms, one of said arms being adapted to support a piece adapted to provide rotation of said cylinder by engaging teeth of an extractor thereof, a second of said arms being adapted to support another piece constituting a first member of a chain adapted to lock or unlock said cylinder in a firing position.

4. The firearm according to claim 3 wherein said connecting member receives motion from a small rod on a side of a distributor opposite a small rod adapted to operate the hammer.

5. The firearm according to claim 4 wherein an insert closes the case and is fastened to said case by two rivets.

6. The firearm according to claim 5 wherein said hammer is traversed by a bore containing a spring that is compressed during rotation of the hammer, said spring slowing down the slide because of the resistance of a pin fixed to the case and having an upper portion traversing the hammer through a slot, said bore being having an upper through portion and a threaded portion adapted to be closed by a screw that acts as regulator of the force of said spring.

7. The firearm according to claim 6 wherein at an opposite side of said screw, a piston slides in the bore until the piston stops thereby setting a time of contact at the hammer with another member.

8. The firearm according to claim 7, further comprising a manually operated pin, said manually operated pin being adapted to prevent an opening of said cylinder when said hammer is armed and to prevent the arming of the hammer when said cylinder is not in a correct position.

9. The firearm according to claim 1, further comprising a mobile sight which is movable by means of moving means, along two directions at right angles, said mobile sight being constituted by a slider and by a sight portion, said moving means comprising a first screw adapted to move said sight portion with respect to said slider and a second screw adapted to move said slider at right angles with respect to motion of said sight portion.

10. The firearm according to claim 9 wherein the motion of said sight portion and of said slide is biased by springs and the rotation of said first and second screws is selectively obtained by a ball engaging in respective dents.

* * * * *